US006041744A

United States Patent [19]

Oota et al.

[11] Patent Number: 6,041,744

[45] Date of Patent: Mar. 28, 2000

[54] FAN SHROUD INTEGRAL WITH RESERVE TANK OF ENGINE COOLING APPARATUS

[75] Inventors: Yosihiko Oota, Tokai; Siniti Oda, Okazaki, both of Japan

[73] Assignee: Denso Corporation, Kariya, Japan

[21] Appl. No.: 09/097,363

[22] Filed: Jun. 15, 1998

[30] Foreign Application Priority Data

Jun. 16, 1997 [JP] Japan ..... 9-158874
Feb. 2, 1998 [JP] Japan ..... 10-021346

[51] Int. Cl.[7] ..... F01P 11/10

[52] U.S. Cl. ..... 123/41.49; 123/41.14

[58] Field of Search ..... 123/41.11, 41.49, 123/41.54; 416/189; 165/125

[56] References Cited

U.S. PATENT DOCUMENTS

| | | | |
|---|---|---|---|
| 3,692,004 | 9/1972 | Tangue et al. | 123/41.49 |
| 3,833,054 | 9/1974 | Gross et al. | 165/67 |
| 4,030,541 | 6/1977 | Gross et al. | 165/175 |
| 4,709,757 | 12/1987 | Bly | 165/173 |
| 4,763,724 | 8/1988 | Temmesfeld et al. | 123/41.14 |
| 5,012,768 | 5/1991 | Roschinski | 123/41.14 |
| 5,649,587 | 7/1997 | Plant | 123/41.49 |

FOREIGN PATENT DOCUMENTS

| | | |
|---|---|---|
| 55-76824 U | 5/1980 | Japan . |
| 1-174518 U | 12/1989 | Japan . |

*Primary Examiner*—Noah P. Kamen
*Assistant Examiner*—Jason Benton
*Attorney, Agent, or Firm*—Harness, Dickey & Pierce, PLC

[57] ABSTRACT

A reserve tank has a tank body integrally formed with a fan shroud with an opening portion and a cover member for covering the opening portion of the tank body. The inside of the tank body is shaped such that a molding die for forming the inside of the tank body can be removed through the opening portion when the tank body is integrally formed with the fan shroud by an injection molding method. The tank body has a concave part around the opening portion and the cover member has a projection for fitting into the concave part to provide a sealing structure. Accordingly, the reserve tank is integrated with the fan shroud without deteriorating moldability and with sealing reliability.

24 Claims, 12 Drawing Sheets

FAN SHROUD INTEGRAL WITH RESERVE TANK OF ENGINE COOLING APPARATUS

CROSS REFERENCE TO RELATED APPLICATIONS

This application is based upon and claims the benefit of priority of the prior Japanese Patent Applications No. 9-158874 filed on Jun. 16, 1997, and No. 10-21346 filed on Feb. 2, 1998, the contents of which are incorporated herein by reference.

BACKGROUND OF THE INVENTION

1. Field of the Invention

This invention relates to a resin fan shroud for surrounding a cooling fan and guiding cooling air to a radiator in an engine cooling apparatus, and particularly to an improvement structure for integrally forming a reserve tank for storing engine coolant with a resin fan shroud.

2. Related Arts

In the past, in Japanese Unexamined Utility Model Publication No. H.1-174518, Japanese Unexamined Utility Model Publication No. S.55-76824, engine cooling apparatuses wherein a reserve tank for storing engine coolant is formed integrally with a resin fan shroud attached to a radiator for engine cooling have been proposed.

By forming the reserve tank integrally with the fan shroud, the reserve tank installation space can be reduced, reserve tank mounting work becomes efficient, and a coolant flow connection hose between the radiator and the reserve tank can be shortened.

However, neither of the above-mentioned prior art examples considers the actual molding method of the resin fan shroud, and their practical application is difficult. Generally, because the fan shroud is a complicated thin plate shape not having a hollow shape, it is formed by an injection molding method. However, in the former example, it is mentioned that the hollow shape of the reserve tank is formed by a blow molding method (a hollow blow-in molding method). That is, the whole of the fan shroud is molded by the blow molding method. In this case, the molding precision of the fan shroud falls greatly compared to the molding precision by the injection molding method, so that practical application becomes difficult.

In the latter example, it is only mentioned that the reserve tank is molded integrally with the fan shroud, and there is no reference to a specific molding method. However, because the reserve tank is of a hollow shape it is necessary for the whole of the fan shroud to be molded by the blow molding method is the same as the former and, again, practical application is difficult.

It is conceivable to, because of this, after a reserve tank body has been injection molded as a separate part from the fan shroud, join an open end of the reserve tank body to a plate-shaped part of the fan shroud by thermal fusion joining or the like and close the open end of the reserve tank body with the plate-shaped part of the fan shroud and thereby form a tank shape.

However, with this measure, after the fan shroud and the reserve tank body are separately molded, it is necessary to set up a joining step of joining these two, and this leads to an increase in the number of manufacturing steps. In addition, a coolant leak inspection of the joint part between the fan shroud and the reserve tank body also becomes necessary, and this leads to a rise in manufacturing cost. Also, with respect to extreme conditions of use in a vehicle or the like, it is difficult to secure adequate reliability in relation to coolant leakage prevention from the joint part of the reserve tank proper.

SUMMARY OF THE INVENTION

The present invention has been made in view of the above-mentioned problems. An object of the present invention is to provide a fan shroud integrally formed with a reserve tank without deteriorating moldability of the fan shroud and the reserve tank. Another object of the present invention is to provide a fan shroud integrally formed with a reserve tank having adequate sealing reliability.

According to the present invention, a reserve tank integrated with a fan shroud member has a tank body defining a tank space therein with an opening portion and a tank cover member for covering the opening portion. The tank space is shaped such that a molding die for forming the tank space is removed through the opening portion when the tank body is integrally formed with the fan shroud by an injection molding method. Accordingly, it becomes possible to simultaneously realize sufficient molding precision of the fan shroud, cost reduction and space requirement reduction of the reserve tank.

Preferably the tank cover member has a filling port for pouring coolant into the tank body and a filling cap for detachably covering the filling port. Therefore, coolant is easily supplied into the reserve tank. The tank cover member may be detachably fitted to the tank body via an anchoring structure. In this case, by removing the cover member, coolant can be poured into the reserve tank. It is not necessary to provide the filling port and the filling cap, resulting in low cost.

Preferably one of a peripheral portion of the opening portion of the tank body and the tank cover member has a concave part, and the other has a projection for fitting into the concave part to thereby provide a sealing portion in cooperation with the concave part. Accordingly, sealing reliability between the tank body and the tank member is realized without an extra sealing member, resulting in low cost.

The tank body and the tank cover member can provide a space around the sealing portion for collecting coolant leaked from the tank body through the sealing portion. Accordingly, even if coolant is leaked from the tank body, the leaked coolant is not directly discharged outside. One of the tank body and the tank cover member can have a step portion elongating from the sealing portion and bent outwardly for forming the space. The step portion can additionally increase rigidity of the one of the tank body and the tank cover member.

Further one of the tank body and the tank cover member can have an anchoring hole, while the other can have a projection for fitting into the anchoring hole, thereby forming an anchoring structure. In this case, the detachment of the tank cover member from the tank body can be prevented even when an inside pressure of the tank body is increased. More preferably the tank body and the tank cover plate have flange-like parts, and the anchoring hole and the projection are formed in and on the flange-like parts. The tank body and the tank cover member can have a plurality of ribs for increasing rigidity thereof.

BRIEF DESCRIPTION OF THE DRAWINGS

These and other objects and features of the present invention will become more readily apparent from a better understanding of the preferred embodiments described below with reference to the following drawings.

DETAILED DESCRIPTION OF THE PREFERRED EMBODIMENTS (First Embodiment)

Figure 1:
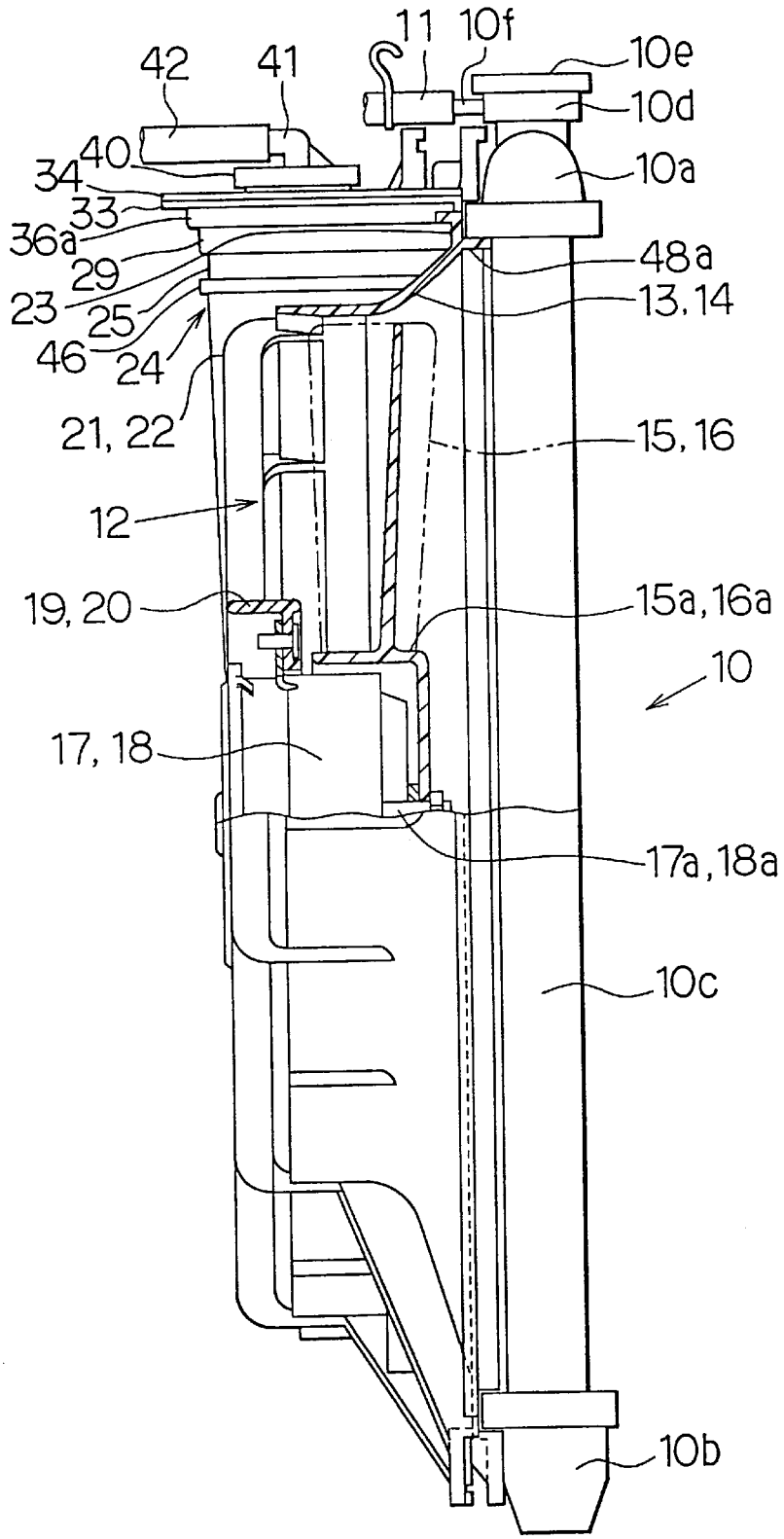
FIG. 1 is a partially sectional side view of an engine cooling apparatus for a vehicle in a first preferred embodiment of the present invention.

FIG. 1 shows an engine cooling apparatus for a vehicle including a fan shroud made of resin according to the present invention and a radiator to which this fan shroud is mounted. Reference numeral 10 is the radiator for cooling hot coolant from an engine (not shown) of a vehicle. Here, the coolant is water containing a component for reducing freezing temperature and a component for preventing rust and so on.

The radiator 10 has an upper tank 10*a,* a lower tank 10*b,* and a core part 10*c* for heat exchange disposed between the upper tank 10*a* and the lower tank 10*b*. The core part 10*c* is made up of numerous flat tubes (not shown) through which coolant flows and corrugated fins (not shown) joined between the flat tubes. Hot coolant from the engine flows through an inlet pipe (not shown) provided on the upper tank 10*a* into the upper tank 10*a,* and is distributed to the numerous flat tubes of the core part 10*c*. While passing through the flat tubes the coolant releases heat through the corrugated fins into cooling air and is cooled. The cooled coolant collects in the lower tank 10*b* and flows back to the engine side through an outlet pipe (not shown) provided on the lower tank 10*b*.

A filling pipe 10*d* for pouring coolant is provided integrally with the top of the upper tank 10*a* of the radiator 10. A pressure cap 10*e* is removably fitted to the filling pipe 1*d,* and an overflow pipe 10*f* is provided on a side face of the filling pipe 10*d*. One end of a connecting hose 11 is connected to the overflow pipe 10*f,* and the other end of the connecting hose 11 is connected to a reserve tank 24 described below.

In the pressure cap 10*e,* positive and negative pressure valves not shown in the drawings are disposed. When the pressure inside the radiator 10 rises as far as a set pressure of the positive pressure valve the positive pressure valve opens and discharges coolant inside the radiator 10 through the overflow pipe 10*f,* and when the pressure inside the radiator 10 becomes negative, the negative pressure valve opens and coolant inside the reserve tank 24 is sucked through the connecting hose 11 and the overflow pipe 10*f* into the radiator 10.

Figure 2:
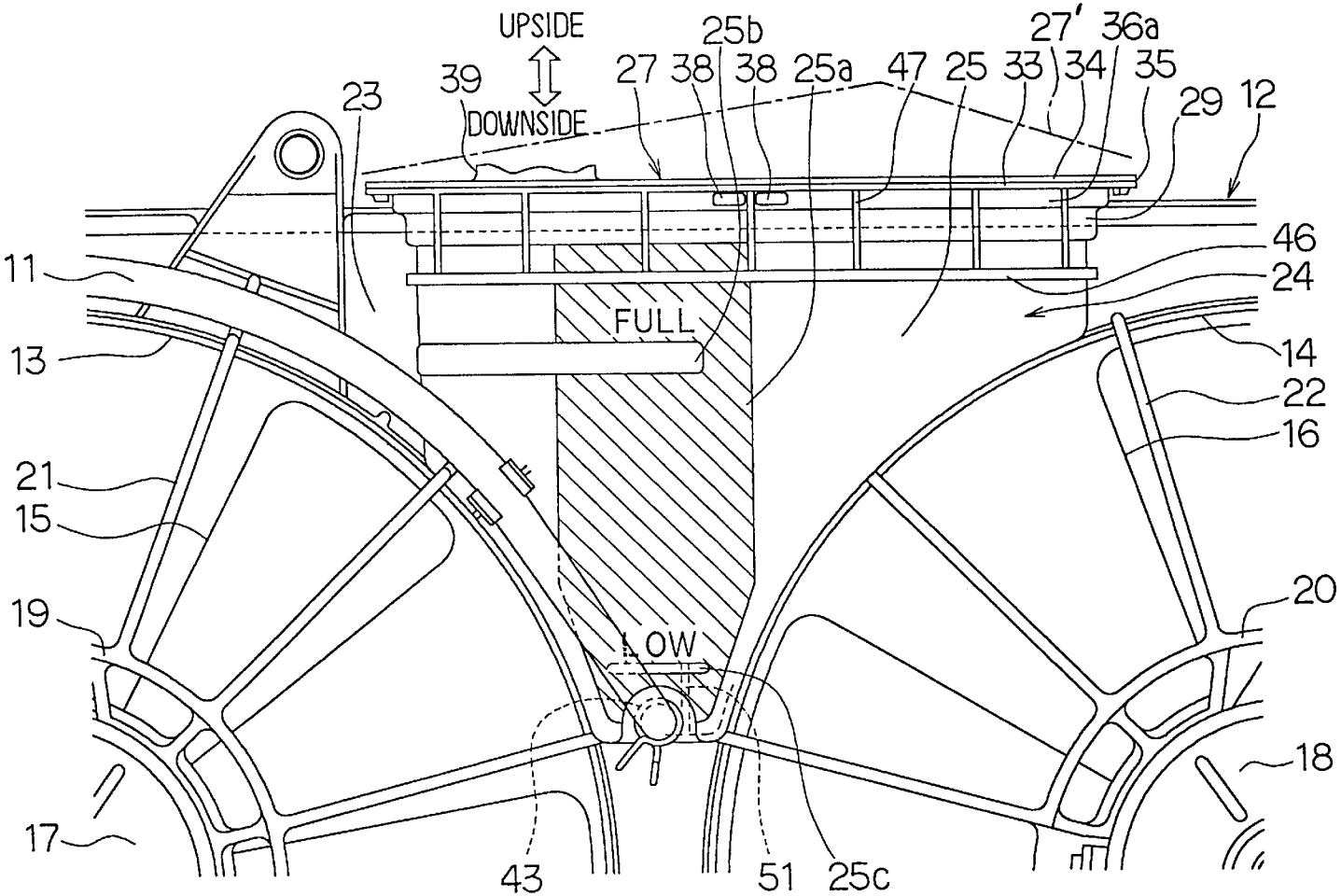
FIG. 2 is an enlarged front view showing a reserve tank integral with a fan shroud on vehicle rear side of in the first embodiment.

The radiator 10 is normally disposed in the frontmost part of an inside of a vehicle engine room, and a fan shroud 12 made of resin is positioned on the vehicle rear side with respect to the radiator 10. The upper and lower ends of the fan shroud 12 are fixed to the upper tank 10*a* and the lower tank 10*b*. FIG. 2 is a view taken from the vehicle rear side of FIG. 1, showing the central upper part of the fan shroud 12. In this example, because the radiator 10 is laterally long in shape, the fan shroud 12 also is laterally long in shape. The fan shroud 12 has two cylindrical air guide parts 13, 14 opened in a line in a left-right direction thereof in FIG. 2. The cylindrical air guide parts 13, 14 respectively hold cooling fans 15, 16.

The cooling fans 15, 16 consist of axial flow fans which are driven by electric motors 17, 18 to draw cooling air toward the radiator 10. The electric motors 17, 18 are disposed inside cylindrical motor holding parts 19, 20 disposed in the central part of the fan shroud 12 as shown in FIG. 1. Housing parts of the electric motors 17, 18 are fixed by fastening means such as screw fastening with respect to the motor holding parts 19, 20. The cylindrical air guide parts 13, 14 and the motor holding parts 19, 20 of the fan shroud 12 are integrally connected to one another by multiple connecting spokes 21, 22 disposed radially.

The cooling fans 15, 16 include blade parts and central cylindrical boss parts 15*a,* 16*a* which are integrally formed using resin. Inner circumference ends of the cylindrical boss parts 15*a,* 16*a* are connected to rotary shafts 17*a,* 18*a* of the electric motors 17, 18 as shown in FIG. 1. Accordingly, the rotary shafts 17*a,* 18*a* and the cooling fans 15, 16 rotate together.

The above-mentioned parts 13, 14, 19, 20, 21, 22 in the fan shroud 12 are all integrally molded (injection molding using a molding die) out of resin. As shown in FIG. 2, a flat plate-shaped part 23 is positioned between the two cylindrical air guide parts 13, 14. The flat plate-shaped part 23 is roughly an inverted triangle shape whose lower side becomes narrow, and has a relatively large area in the fan shroud 12.

In this embodiment, the reserve tank 24 is integrally provided with the flat plate-shaped part 23. The specific structure of this reserve tank 24 will now be described in detail.

Figure 3:
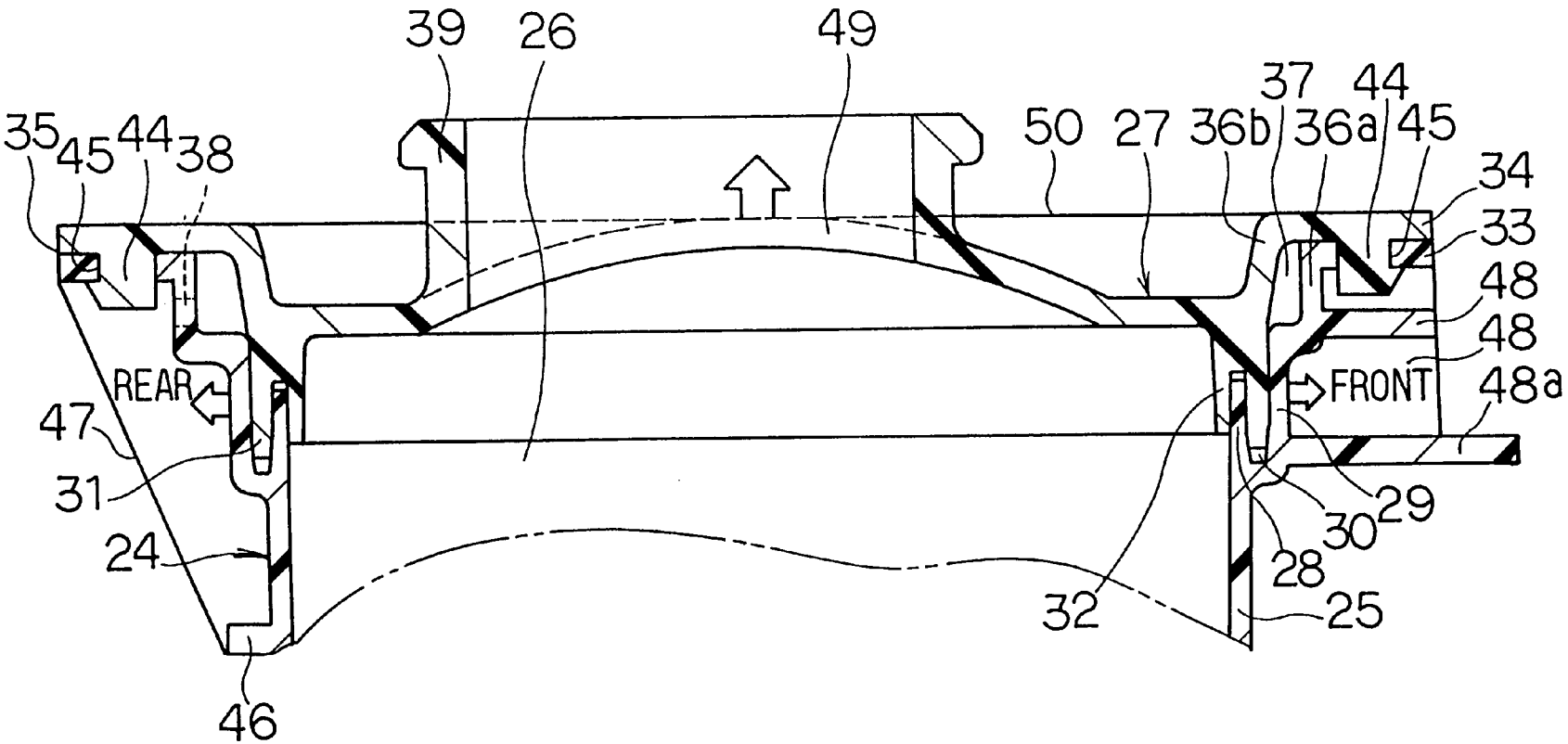
FIG. 3 is a vehicle front-rear direction enlarged sectional view partially taken along III—III line of FIG. 4, partially showing the reserve tank in the first embodiment.
Figure 4:
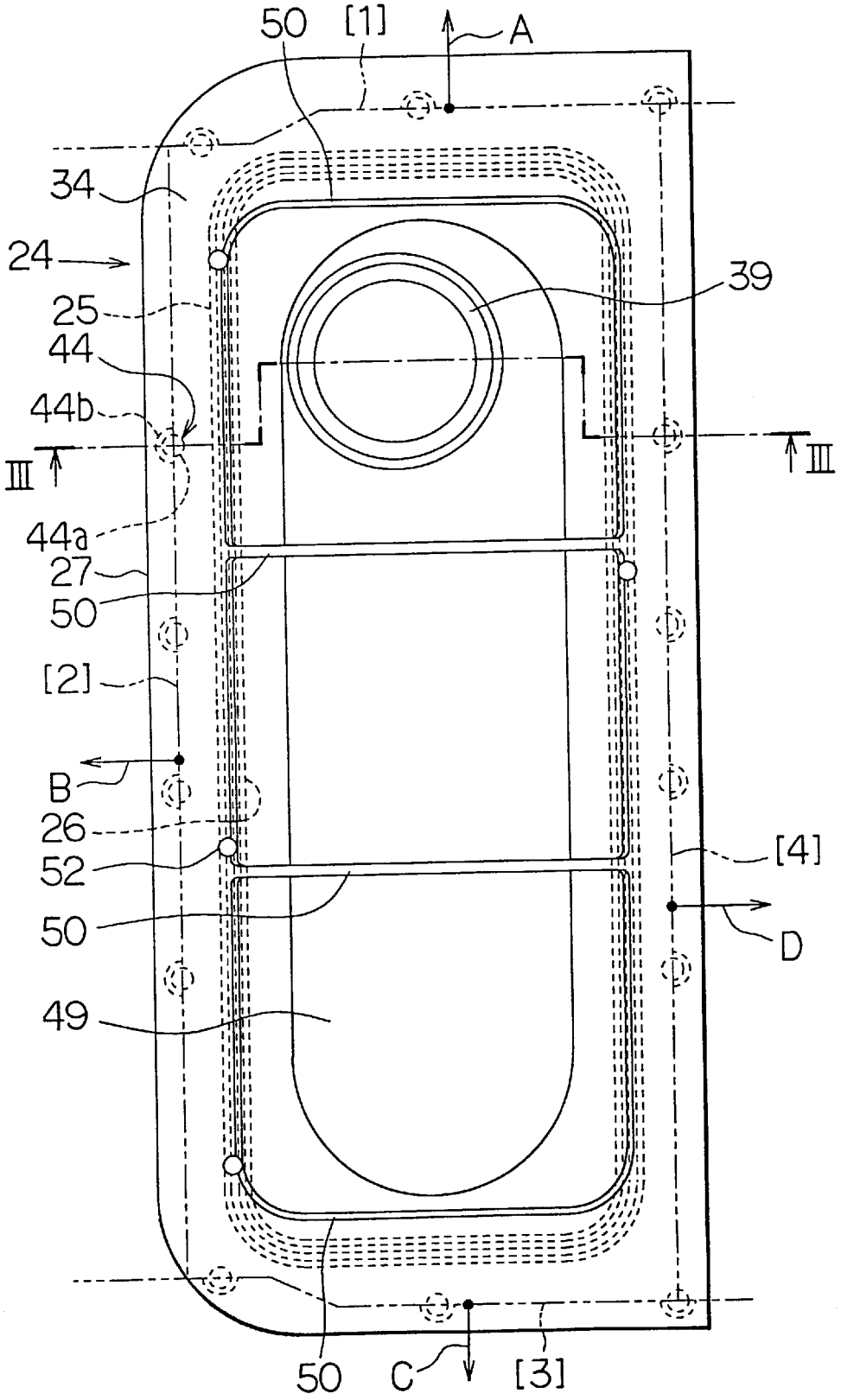
FIG. 4 is a top view of the reserve tank, and shows a state wherein a filling cap has been removed from a cover member.
Figure 5:
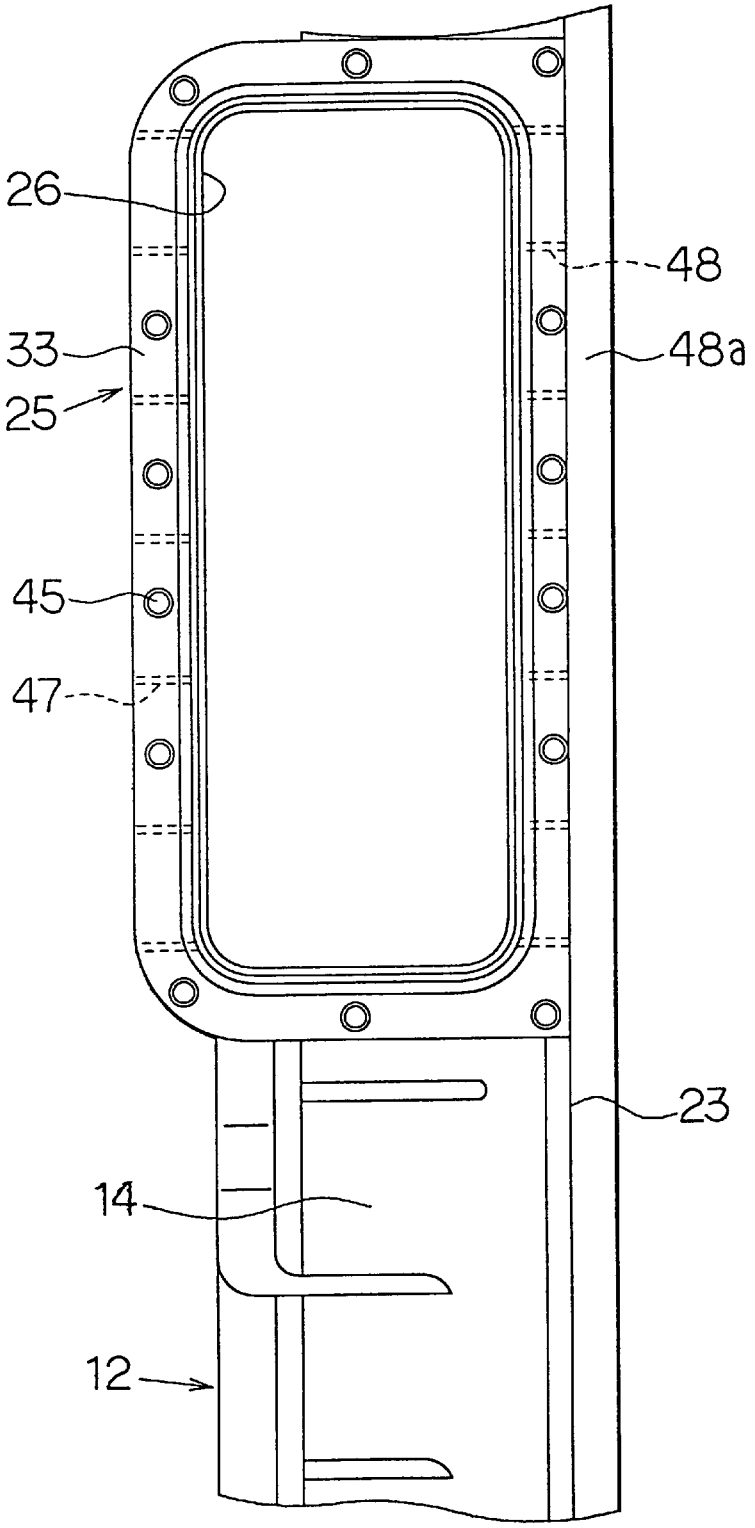
FIG. 5 is a top view of the reserve tank, and shows a state wherein the cover member has been removed from a tank body.

FIG. 3 to FIG. 5 are detail views of the reserve tank 24, and FIG. 3 is a III—III section of FIG. 4. The reserve tank 24 is basically made up of a tank body 25 and a cover member (tank cover member) 27 for covering an opening part 26 provided at the upper side of this tank body 25. FIG.

5 shows a state wherein the cover member 27 is removed from the opening part 26 of the tank body 25, and as shown in FIGS. 4, 5 the opening part 26 is a rectangle laterally long in the left-right direction (width direction) of the fan shroud 12.

The tank body 25 is integrally formed with the fan shroud 12 by an injection molding method, and forms a tank shape projecting to the left side direction of FIG. 5 (FIGS. 1, 4) (the vehicle rear direction) with a face of the flat plate-shaped part 23 of the fan shroud 12 positioned at the right end part of FIG. 4 as a starting point. That is, at the upper side of the fan shroud 12 the tank body 25 has a rectangle sectional shape shown in FIG. 5 and protrudes to the vehicle rear side from the face of the flat plate-shaped part 23. At the lower side the tank body 25 is gradually miniaturized along the outer circumferential faces of the two cylindrical air guide parts 13, 14 of the fan shroud 12 as shown in FIG. 2, and at the lowermost part forms a bottom wall part where its sectional area is smallest.

Here, for integrally molding the tank body 25 with the fan shroud 12 by the injection molding method, the opening area of the opening part 26 at the upper side is set so that a slide core (a movable core of a molding die) for molding the inside shape of the tank body 25 can be removed upward in FIGS. 2, 3 through the opening part 26 after the fan shroud 12 is molded. Specifically, the sectional area of the inside of the tank body 25 is set so that it increases with progress upward from the bottom of FIGS. 2, 3 to the top and the sectional area becomes the maximum at the opening part 26. As a result upward removal of a slide core becomes possible.

The cover member 27 for covering the opening part 26 of the tank body 25 is formed by being separately injection molded out of resin in a laterally long rectangle matching the opening part 26. When the cover member 27 is fitted to the opening part 26 of the tank body 25, to prevent leakage of coolant from that fitting part, it is necessary for a seal mechanism to be provided at the fitting part of the cover member 27 with the opening part 26 of the tank body 25.

Accordingly, the seal mechanism of the fitting part of this cover member 27 will be described next. The cover member 27 is made to be press-fitted from above onto the opening part 26 of the tank body 25, and in this press-fitting part the seal mechanism consisting of a labyrinth structure is provided.

That is, in this embodiment, sectionally U-shaped double wall parts 28, 29 (see FIG. 3) are formed around the entire periphery of the end face of the opening part 26 of the tank body 25, so that a concave part 30 opening upward is provided between the double wall parts 28, 29. Further, the lower face of the cover member 27 has a projection 31 projectingly formed to match the concave part 30. The thickness of the projection 31 is made to be slightly larger than the groove width of the concave part 30 so that the projection 31 is pressed into the concave part 30. As a specific design example, the thickness of the projection 31 is 1.9 mm, and the groove width of the concave part 30 is 1.6 mm.

Further a waterproofing wall 32 is projectingly formed on the lower face of the cover member 27 around the entire inner side of the projection 31. The waterproofing wall 32 prevents coolant directly entering the above-mentioned seal mechanism, for example, when coolant has filled the inside of the tank body 25 or when a phenomenon such as liquid splashing due to vibration has occurred at a low liquid level of coolant in the tank body 25.

Here, the gap dimension between the waterproofing wall 32 and the projection 31 is set slightly larger than the thickness of the inner side wall part 28 of the tank body 25 so that a small gap (for example about 0.4 mm) is formed between the waterproofing wall 32 and the inner side wall part 28. If the assembly the inner side wall part 28 is press-fitted to the gap between the waterproofing wall 32 and the projection 31, the cover member 27 is press-fitted to the opening part 26 of the tank body 25 at two locations, the projection 31 and the inner side wall part 28. Therefore, the fitting operation needs excessive assembly, so that the fitting operation becomes difficult. To avoid this, in this embodiment, the above-mentioned assembly structure such that a small gap is formed between the waterproofing wall 32 and the inner side wall part 28 is adopted to facilitate the operation of fitting the cover member 27.

In this embodiment, as mentioned above, the seal mechanism consisting of the labyrinth structure capable of extending a flow route length of seal faces is provided by the waterproofing wall 32 being combined with the above-mentioned press-fitting part between the concave part 30 and the projection 31. With this seal mechanism, a substantially good seal property can be maintained by means of the above-mentioned labyrinth structure. Furthermore, because no separate parts for sealing such as packings are used, cost is low. However, in this seal mechanism, because sealing members such as packings are not used, the level of the seal is not perfect and there are cases wherein a little minor leakage occurs.

With respect to minor leakage from the above-mentioned seal mechanism, the following countermeasure is taken. Of the double wall parts 28, 29, the upper part of the outer side wall part 29 stands up further than the inner side wall part 28, and at the uppermost part of the outer side wall part 29 a flange-like part 33 (see FIG. 5) extending toward the tank outer side in the horizontal direction is formed around the entire periphery of the outer side wall part 29. In correspondence with this flange-like part 33, a flange-like part 34 (see FIG. 4) is formed all the way around the outer periphery of the cover member 27. These two flange-like parts 33, 34 constitute a mating face 35 (see FIG. 3) by abutting each other when the cover member 27 is fitted to the tank body 25.

The upward standing part of the outer side wall part 29 has a step part (bend-shaped part) 36*a* bent to the tank outer side. The cover member 27 has an upward extension part (bend-shaped part) 36*b* bending from the upper side of the projection 31 to the tank outer side between the projection 31 and the flange-like part 34. When the cover member 27 is fitted to the tank body 25, the step part 36*a* of the tank body 25 and the upward extension part 36*b* define a space 37 therebetween. Therefore, even if a small amount of coolant leaks from an unspecified area of the tank periphery through the press-fitting part between the concave part 30 and the projection 31, the leaking coolant can be temporarily collected inside the space 37 not to be immediately leaked to the outside.

Drain openings 38 (see FIGS. 2, 3) for, when coolant has entered the space 37, finally discharging the coolant to the outside are formed in parts of the step part 36*a*. Specifically, of the step part 36*a*, drain openings 38 are opened in two locations in the left-right direction central part on the vehicle rear side. Here, when coolant leaks out from the mating faces 35 at the outermost periphery which is most easily seen in the fan shroud 12, the appearance is bad. However, in this embodiment, because as shown in FIG. 3 the drain openings 38 are disposed below the mating faces 35 at the outermost periphery and in recessed and difficult to see locations, even if coolant leaks out through the drain openings 38 a deterioration in appearance can be avoided.

Figure 6:
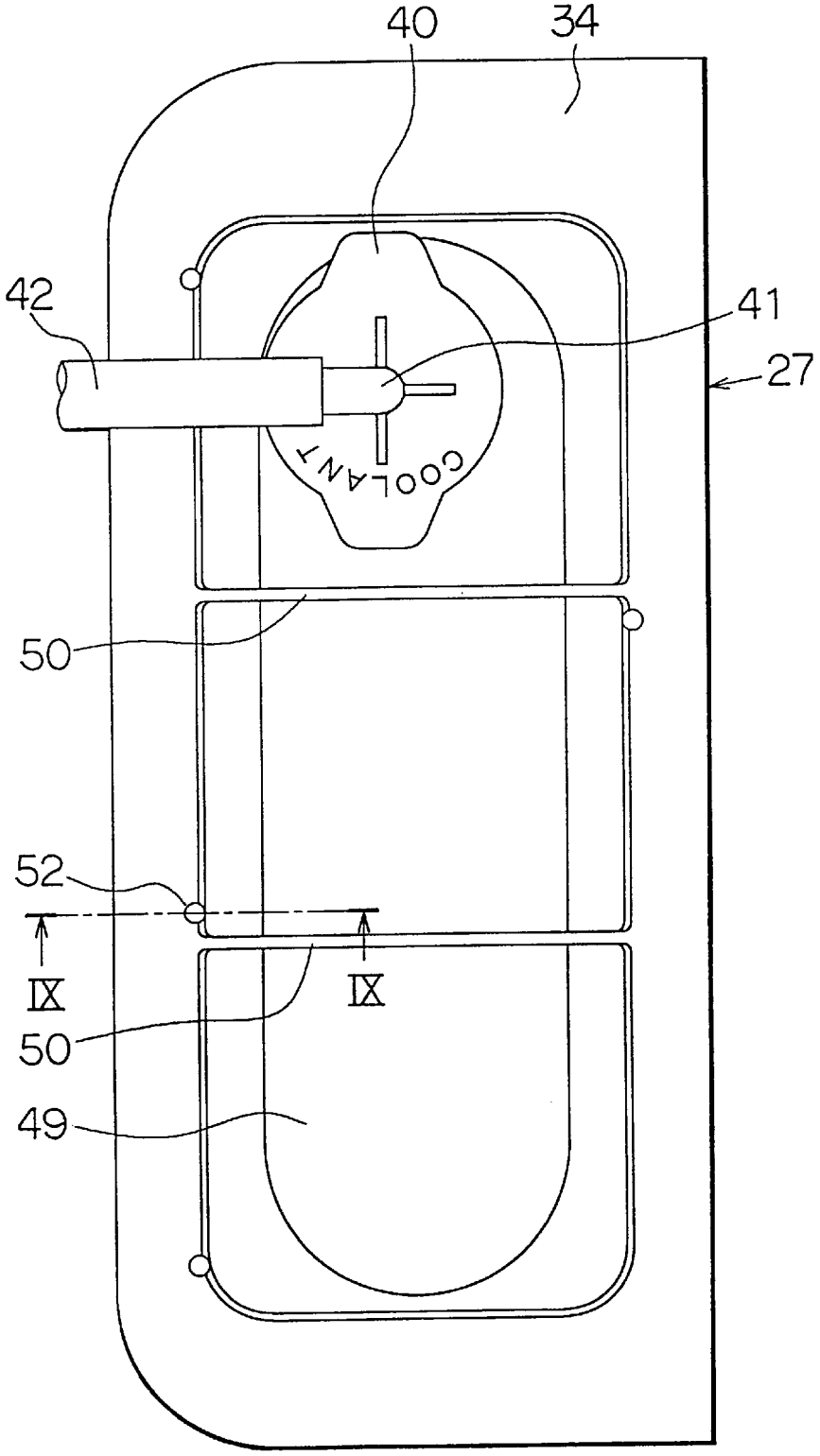
FIG. 6 is a top view of the reserve tank showing a state wherein a filling cap has been fitted to the cover member of FIG. 4.

Now, as shown in FIGS. 3, 4 a filling pipe (filling port) 39 for pouring coolant into the reserve tank 24 is integrally formed with the cover member 27 so as to project upward, and a resin filling cap (filling cover member) 40 shown in FIG. 6 is removably fitted to the filling pipe 39. The removable structure of the filling cap 40 may be a known one, and for example may be a structure such that by a turning operation of the filling cap 40 an engaging claw (not shown) of the filling cap 40 is engaged with or disengaged from an engaging part of the upper end opening of the filling pipe 39.

A drain pipe 41 connecting the inside and the outside of the filling cap 40 is integrally formed in the central part of the filling cap 40, and to this drain pipe 41 an end of a drain hose 42 is connected. The other end of the drain hose 42 is disposed on the lower side of the fan shroud 12 so as to discharge coolant. The inside of the reserve tank 24 in the normal state is open to the atmosphere through the drain hose 42 of the filling cap 40.

Also, as shown in FIG. 2 a connecting pipe 43 communicating with the inside of the reserve tank 24 is integrally formed at the lowermost part of the tank body 25 of the reserve tank 24. The lower end part of the above-mentioned connecting hose 11 of the radiator 10 is connected to this connecting pipe 43. As a result, the inside of the reserve tank 24 communicates with the filling pipe 10*d* of the radiator 10.

Next, a measure for preventing the cover member 27 from coming off due to increase in the internal pressure of the reserve tank 24 will be described. In an engine cooling apparatus for a vehicle, in consideration of safety in the market, it is demanded that pressure-withstanding strength be designed considering not normal overheating but also extreme overheating wherein the inlet coolant temperature of the radiator 10 is 140° C. or more.

In this kind of extreme overheating state, because internal pressure of the cooling system circuit rises due to coolant temperature rise, the positive pressure valve built in to the pressure cap 10*e* of the radiator 10 is constantly kept in its open state. Therefore, from the side of the radiator 10 coolant continuously passes through the connecting hose 11 and flows into the inside of the reserve tank 24. Consequently, the inside of the reserve tank 24 becomes filled with coolant and the internal pressure of the reserve tank 24 rises to take off the cover member 27.

To overcome this, in this embodiment, measures are taken to raise the pressure-withstanding strength of the fitting structure of the cover member 27 to the tank body 25, and it is set so that at the time of an internal pressure rise of the reserve tank 24 the filling cap 40 comes off before the cover member 27. This at the same time prevents detachment of the cover member 27 also when (at a normal temperature) the filling cap 40 is removed at a time of pouring liquid into the reserve tank 24, which is extremely convenient in practice.

As specific measures for preventing detachment of the cover member 27, the two measures of a primary anchoring structure part of the cover member 27 and a secondary rigidity increasing measure of increasing the overall rigidity of the cover member fitting part vicinity and thereby making it possible for the primary anchoring structure part to be held in a proper state are employed. The secondary rigidity increasing measure makes the primary anchoring structure part securely work.

First, explaining the primary anchoring structure of the cover member 27, on the underside of the flange-like part 34 of the cover member 27 as shown in FIGS. 3, 4 a plurality of engaging projections 44 are integrally formed all the way around and these engaging projections 44 are pushed from above into anchoring holes 45 opened in the flange-like part 33 of the tank body 25 to fit the anchoring holes 45.

Figure 7A:
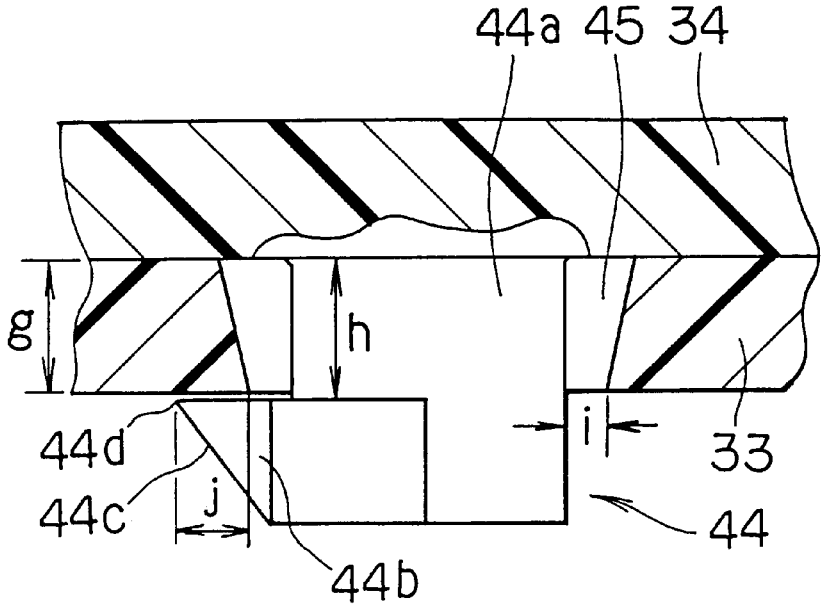
FIG. 7A is a sectional view partially showing an anchoring structure of the cover member and the tank body.
Figure 7B:
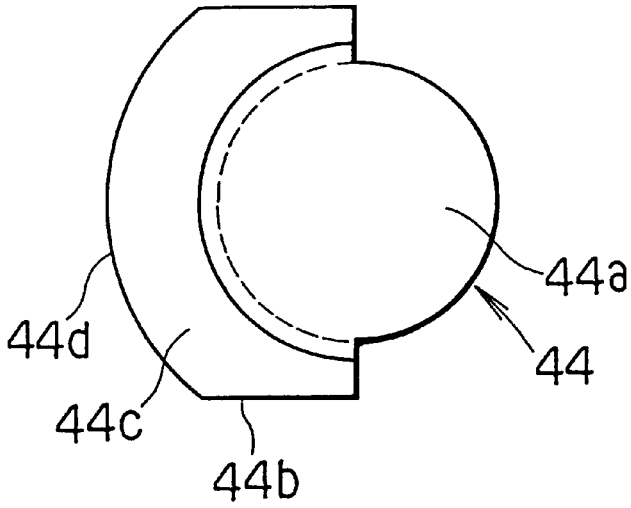
FIG. 7B is a front view of an engaging projection shown in FIG. 7A.

FIG. 7 is an enlarged view of a fitting part between one of the engaging projections 44 and a corresponding one of the anchoring holes 45. The engaging projection 44 is made up of a pillar part 44*a* and a claw part 44*b* formed on the tip side of this pillar part 44*a*. Here, the claw part 44*b* projects outward in the radial direction of the pillar part 44*a* to be in a circular arc shape, and as shown in FIGS. 4, 7B in all of the engaging projections 44 the claw part 44*b* is formed only on the tank outer side half-circumference part.

The reason for setting the formation position of the claw part 44*b* in this way is to simplify the die structure for injection molding the cover member 27 and reduce die costs. That is, in FIG. 4, the double-dash chain lines [1] to [4] are parting lines of molding dies for injection molding the cover member 27, and the claw parts 44*b* are positioned on the outer sides of these parting lines [1] to [4]. By this means, the parts on the tank outer sides of the die parting lines [1] to [4] can be molded by horizontally sliding four divided dies respectively in directions of arrows A to D of FIG. 4. On the other hand, because the part on the inner side of the die parting lines [1] to [4] has no undercut shapes caused by the claw parts 44*b*, it can be molded with a single die sliding in a direction perpendicular to the paper face of FIG. 4 (the vertical direction), and the die structure can be simplified.

Next, explaining a specific dimensional relationship between the engaging projection 44 having the claw part 44*b* and the anchoring hole 45, the anchoring hole 45 is made a conical hole shape whose hole diameter decreases with progress from the upper end part to the lower end part as shown in FIG. 7. The maximum diameter at the upper end of the anchoring hole 45 is for example ϕ6.0 mm and the minimum diameter at the lower end of the anchoring hole 45 is for example ϕ5.2 mm.

The external diameter of the pillar part 44*a* of the engaging projection 44 is made smaller than the minimum diameter of the anchoring hole 45 and is for example ϕ4.0 mm. The thickness g (=the axial direction height of the anchoring hole 45) of the flange-like part 33 of the tank body 25 is made slightly (for example 0.2 mm) smaller than the axial direction height h of the pillar part 44*a* of the engaging projection 44. Also, so that the claw part 44*b* is easy to push into the anchoring hole 45, its radius of curvature is decreased with progress toward the axial direction tip side of the engaging projection 44, thereby forming a sloping face 44*c*. At the portion 44*d* of the claw part 44*b* having the largest radius of curvature, radius of curvature R is made larger than the radius of the largest-diameter portion of the anchoring hole 45. For example, radius of curvature R is 3.65 mm in this embodiment.

Because the engaging projection 44 and the anchoring hole 45 are disposed coaxially as shown in FIGS. 7A, 7B, gap i is formed all the way around between the pillar part 44*a* of the engaging projection 44 and the anchoring hole 45. Therefore, when the engaging projection 44 is inserted into the anchoring hole 45, the claw part 44*b* makes pressing contact with the inner wall face of the tank outer side of the anchoring hole 45 and consequently the engaging projection 44 elastically deforms to the tank inner side within the anchoring hole 45.

In this way, the claw part 44*b* can pass through the anchoring hole 45. After the claw part 44*b* passes through the anchoring hole 45, the engaging projection 44 returns to the state of FIG. 7A under its own elastic restoring force and forms anchoring allowance j between the claw part 44*b* of the engaging projection 44 and the edge of the minimum diameter part at the lower end side of the anchoring hole 45, and performs anchoring of the cover member 27. In this embodiment, a radial direction width of anchoring allowance j is 1.05 mm.

The fitting of the cover member 27 to the tank body 25 is, in practice, carried out with priority being given to the press-fitting part between the projection 31 and the concave part 30 constituting the seal mechanism. Then, with this press-fitting part as a fitting reference of the cover member 27, pushing of the engaging projection 44 into the anchoring hole 45 is carried out. At that time, dimensional tolerances on the side of the press-fitting part between the projection 31 and the concave part 30 may cause positional deviation between the engaging projection 44 and the anchoring hole 45. However, in such a case, the positional deviation is absorbed by gap i running all the way around between the pillar part 44*a* and the anchoring hole 45, so that the insertion of the engaging projection 44 into the anchoring hole 45 is made possible.

In this embodiment, to simplify the die structure, the claw part 44*b* of the engaging projection 44 is formed on the tank outer side half-circumference part of the engaging projection 44. Instead, to raise the anchoring strength (that is, the pressure-withstanding strength) of the cover member 27, the claw part 44*b* of the engaging projection 44 may be formed all the way around. In this case, the number of divisions of die is increased (increase of die costs). In this case, because as a result of the all-round formation of the claw part 44*b* the push-in force of the engaging projection 44 increases and the work facility deteriorates, it becomes necessary to adjust anchoring allowance j. Here, the push-in force is a force that the engaging projection 44 necessitates to be inserted into the anchoring hole 45. When the claw part 44*b* of the engaging projection 44 is formed all the way around, as a measure to reduce the push-in force of the engaging projection 44, a radial slit passing through in the axial direction of the engaging projection 44 may be formed. The claw part 44*b* is thereby made to deform more readily to the inner side in the radial direction.

Next, the measure of increasing the rigidity of the cover member fitting part vicinity, which is the secondary measure for preventing detachment of the cover member 27, will now be described. When the cover member 27 and the tank body 25 are of low rigidity, as a result of the high temperature, high pressurization of coolant in extremely overheating conditions, as shown in FIG. 3, the tank body 25 is deformed in the vehicle front-rear directions as shown with arrows. At the same time, the cover member 27 is deformed in the upward direction as shown with an arrow.

As a result, the cover member 27 deforms in an inverted V-shape as shown with the single-dash chain line 27' of FIG. 2, and the anchor parts (the engaging projections 44) of the cover member 27 may detach from the tank body 25. This can cause a phenomenon of hot water inside the reserve tank 24 may spraying out to the outside. Accordingly, as a countermeasure to this, first, the tank body 25 is formed with a horizontal rib 46 projecting in the horizontal direction below the two double wall parts 28, 29 on the vehicle rear side. This horizontal rib 46 is to prevent the deformation of the tank body 25 to the vehicle rear side, and is formed in a C-shape extending along the left and right side face parts and the rear face part of the tank body 25 projecting to the vehicle rear side.

Figure 8:
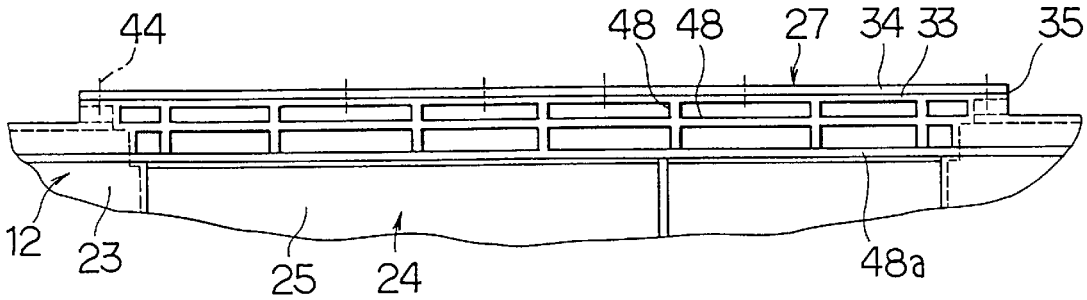
FIG. 8 is an enlarged view showing the reserve tank part on the vehicle front side.

Further, to maintain the horizontality of the mating faces 35 of the flange-like part 33 of the tank body 25 and the flange-like part 34 of the cover member 27, a vertical rib 47 is formed on the rear face part of the tank body 25 in a form connecting the above-mentioned horizontal rib 46 and the flange-like part 33. To prevent deformation to the vehicle front side and maintain the horizontality of the mating faces 35, gridlike ribs 48 shown in FIG. 8 are formed on the face on the vehicle front side (i.e. the front face part) of the tank body 25. Of these gridlike ribs 48, a rib 48*a* extending in the horizontal direction on the lower side is formed extending over substantially the entire length of the fan shroud 12 in the left-right direction (the width direction).

Also, for the cover member 27, as shown in FIGS. 3, 4 and 6 a curved part 49 curved upward in an arch is formed in the central part of the cover member 27 to prevents the inverted V-shape deformation (the deformation of the single-dash chain line 27' of FIG. 2). Further, to maintain the horizontality of the mating faces 35 of the flange-like part 34 on the outer periphery side of the cover member 27, as shown in FIG. 4, a plurality of ribs 50 extending in the vehicle front-rear direction are formed, and the span of the flange-like part 34 in the vehicle front-rear direction is connected by these ribs 50.

In addition, because the step part 36*a* of the tank body 25 and the upward extension part 36*b* of the cover member 27 forming the space 37 for collecting leaked coolant are formed all the way around the tank, they also perform the role of increasing the rigidity of the fitting part vicinity of the cover member 27 and the tank body 25.

As a result of the combination of rigidity-increasing measures described above, the amount of deformation of the cover member 27 in the extremely overheating conditions is suppressed to about ⅓ compared to when these countermeasures are not taken, and the pressure-withstanding strength objective of making the filling cap 40 come off before the cover member 27 is secured.

Next, measures for increasing the visual checkability from outside of the amount of coolant inside the reserve tank 24 will be discussed. The color of the resin fan shroud 12 normally in consideration of its attractiveness is black. As the resin material of the fan shroud 12 it is polypropylene-glass type or polypropylene-talc type, and an amount of carbon which is a black pigment is by weight ratio about 0.1% of the whole. With this amount of carbon in the fan shroud 12, even when the plate thickness was made the minimum value allowed by design it was completely impossible to visually check the liquid level.

In this connection, to solve the problem of it not being possible to visually check the coolant level inside the reserve tank 24 with the black fan shroud 12, the amount of carbon, which is the black pigment, is reduced to an amount (0.001 wt % to 0.003 wt %) such that visual checking is possible. As a result, the color of the overall fan shroud 12 including the reserve tank 24 part became gray and it becomes possible to visually check the coolant level inside the reserve tank 24.

When the fan shroud 12 is the gray color its appearance inside the engine room is likewise good. It is also possible to make the carbon amount 0% and thereby make the color of the fan shroud 12 the natural color of polypropylene resin (a semi-transparent white). Further, the carbon amount may be made 0% and a pigment of another color, for example pigments of blue and pearl may be added in a small quantity to make the color of the fan shroud 12 a semi-transparent gray.

In FIG. 2, the diagonal line part 25*a* of the rear face part of the tank body 25 is a coolant level checking part having coolant level display marks 25*b*, 25*c*. At the coolant level checking part 25*a* the tank wall thickness is made thin compared to the tank wall thickness of other parts to make it more easy to visually check. As a specific design example, the tank wall thickness of the liquid level checking part 25*a* is 1.5 mm, and the tank wall thickness of other parts is 2.0 mm. The display mark 25*b* shows a full state of coolant (FULL) and the display mark 25*c* shows a minimum amount of coolant (LOW).

Also, when the color of the fan shroud 12 is made the gray in this embodiment, compared with a white natural color when the coolant in the tank has become completely empty the whole tank is difficult to visually check. Therefore, there is a possibility of it being misconceived that the coolant is in a full state even though the inside of the tank is empty. As a countermeasure to this, in this embodiment, as shown in FIG. 2, a partition plate 51 extending in the vertical direction is provided at the bottom of the tank body 25, and a space divided from a space on the connecting pipe 43 side is thereby formed at the bottom of the inside of the tank body 25.

Therefore, even when the liquid level inside the tank body 25 becomes below the LOW level of FIG. 2 and the remaining amount inside the tank has become 0, the inside of the right side space partitioned by the partition plate 51 performs the role of a storage tank and a small amount of coolant always remains in this right side storage tank. Consequently, a color difference arises between the empty part inside the tank and the part on the right side of the partition plate 51 in which a small amount of coolant remains, and it can be easily determined that the inside of the tank is empty. In the example of FIG. 2, the height of the partition plate 51 is matched to the level of the minimum amount (LOW) display mark 25*c*.

As for the color of the cover member 27, it may be the same gray color as the reserve tank 24 or, if appearance is considered, it may be ordinary black.

Figure 9:
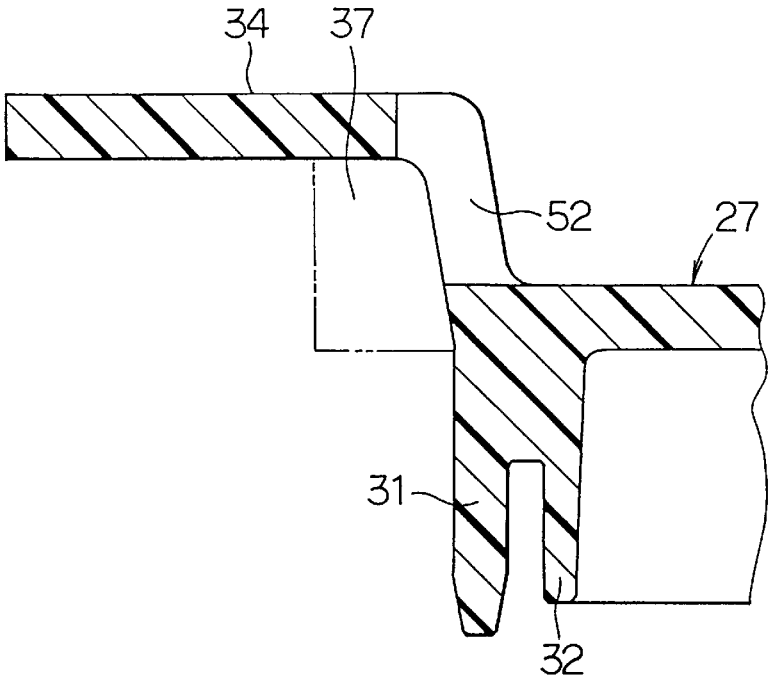
FIG. 9 is a sectional view taken along IX—IX line in FIG. 6, partially showing the cover member.

In this embodiment, as another point of contrivance, rainwater discharge holes 52 shown in FIGS. 4, 6 are disposed in the cover member 27. The rainwater discharge holes 52 are circular holes a plurality of which are provided in the edge part of the inner periphery side of the flange-like part 34, and the rainwater discharge holes 52 connect with the space 37 for leaked coolant collection. FIG. 9 (a sectional view taken along IX—IX line of FIG. 6) shows the sectional shape of one of the rainwater discharge holes 52. Because rainwater collected on the top side of the cover member 27 flows once through the discharge holes 52 into the space 37 and is discharged through the drain openings 38 in the same way as a little leaked coolant.

Further, as described above the cylindrical air guide parts 13, 14 and the cylindrical motor holding parts 19, 20 of the fan shroud 12 are integrally connected by numerous connecting spokes 21, 22 disposed radially. Therefore, even when the weight of coolant inside the reserve tank 24 is increased in the full state, it is possible to easily secure the necessary strength of the fan shroud 12 by the numerous connecting spokes 21, 22.

(Second Embodiment)

Figure 10:
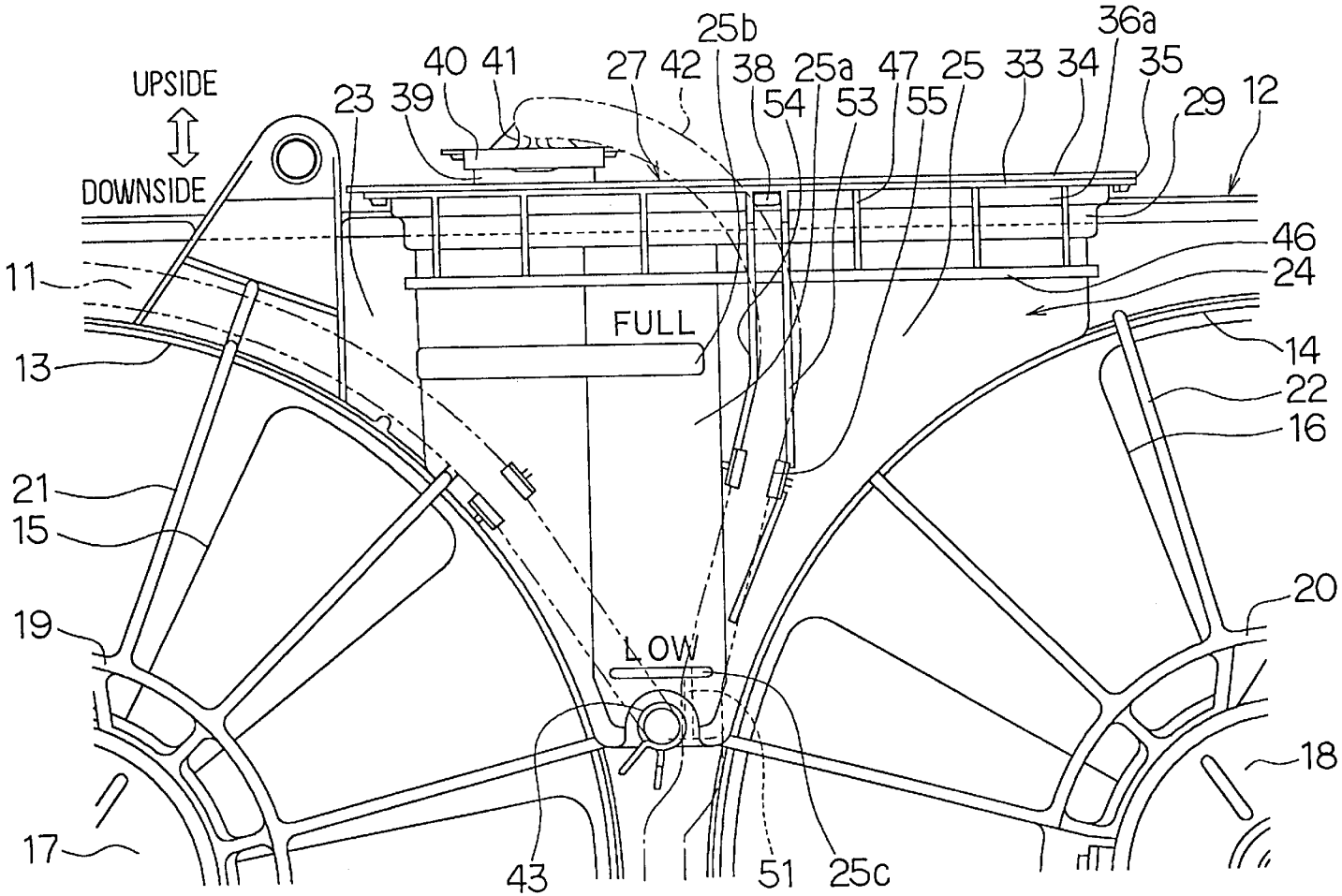
FIG. 10 shows an enlarged front view showing a reserve tank integral with a fan shroud on a vehicle rear side in a second preferred embodiment.
Figure 11:
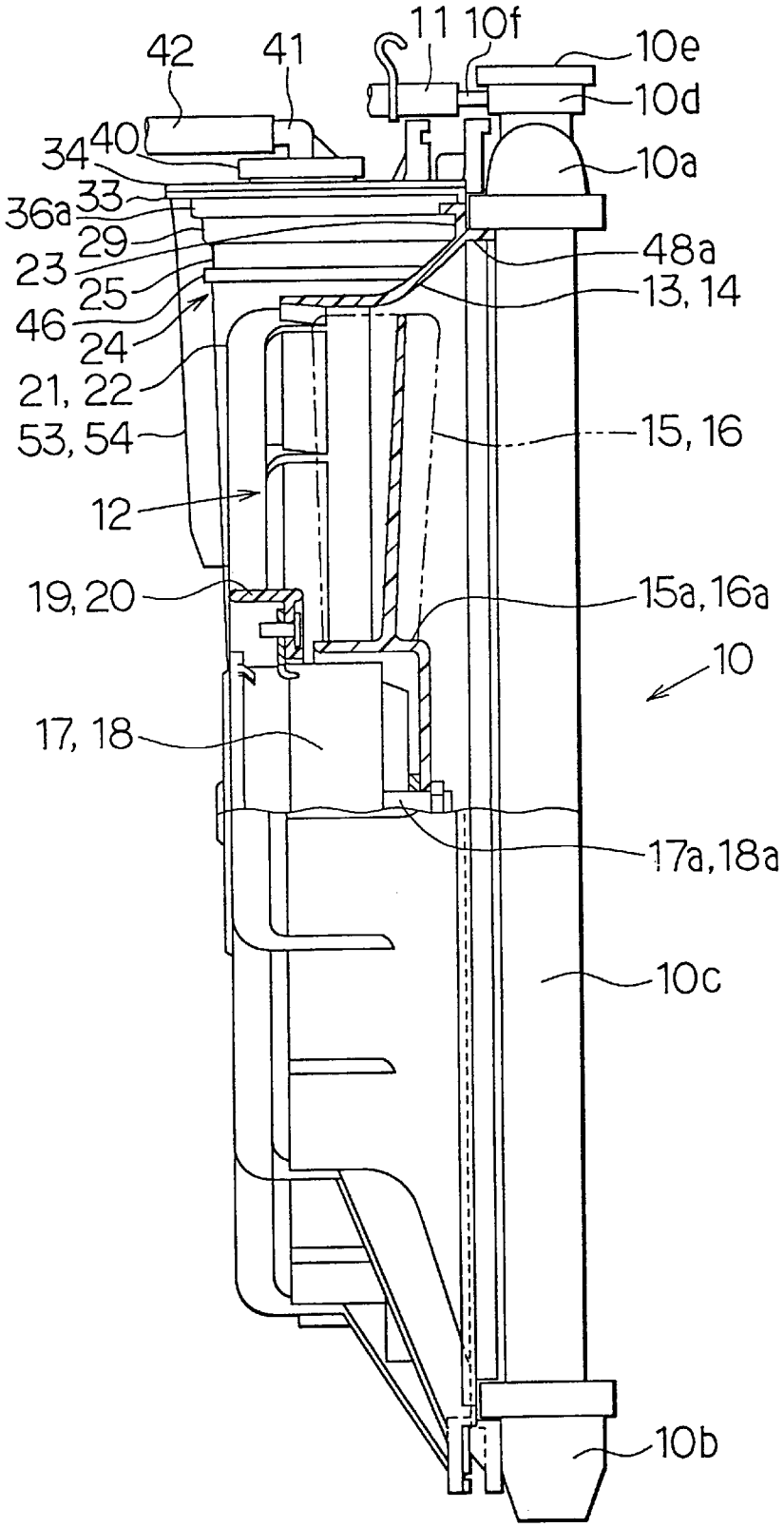
FIG. 11 is a partially sectional side view of an engine cooling apparatus for a vehicle comprising the fan shroud of FIG. 10.

FIGS. 10, 11 show a second preferred embodiment of the present invention. The same parts and components as those in the first embodiment are indicated with the same reference numerals and the same descriptions will not be reiterated. In this embodiment a drain opening 38 positioned at the top of the tank body 25 is provided in only one location, and two guide walls 53, 54 extending vertically downward are provided on the left and right sides of this drain opening 38. The guide walls 53, 54 project from the tank body 25 to the vehicle rear side (see FIG. 11), and as well as guiding coolant from the drain opening 38 also perform the role of the vertical rib 47 in the embodiment described above.

The lower sides of the two guide walls 53, 54 terminate at a position in the proximity of the lower end of the coolant level checking part 25*a*. Part-way along the two guide walls 53, 54 in the vertical direction a hose clamp 55 is integrally formed. The hose clamp 55 is of a two-thigh form for clamping the drain hose 42 extending from the filling cap 40 by an elastic force of resin. The drain hose 42 is made to descend vertically along the guide walls 53, 54 by this hose clamp 55. Accordingly, because the two guide walls 53, 54 can be covered by the drain hose 42, when coolant discharged through the drain opening 38 descends between the two guide walls 53, 54, because the descent of this coolant is covered by the drain hose 42, the appearance can be improved. The other features and effects are the same as those in the first embodiment.

(Third Embodiment)

Figure 12:
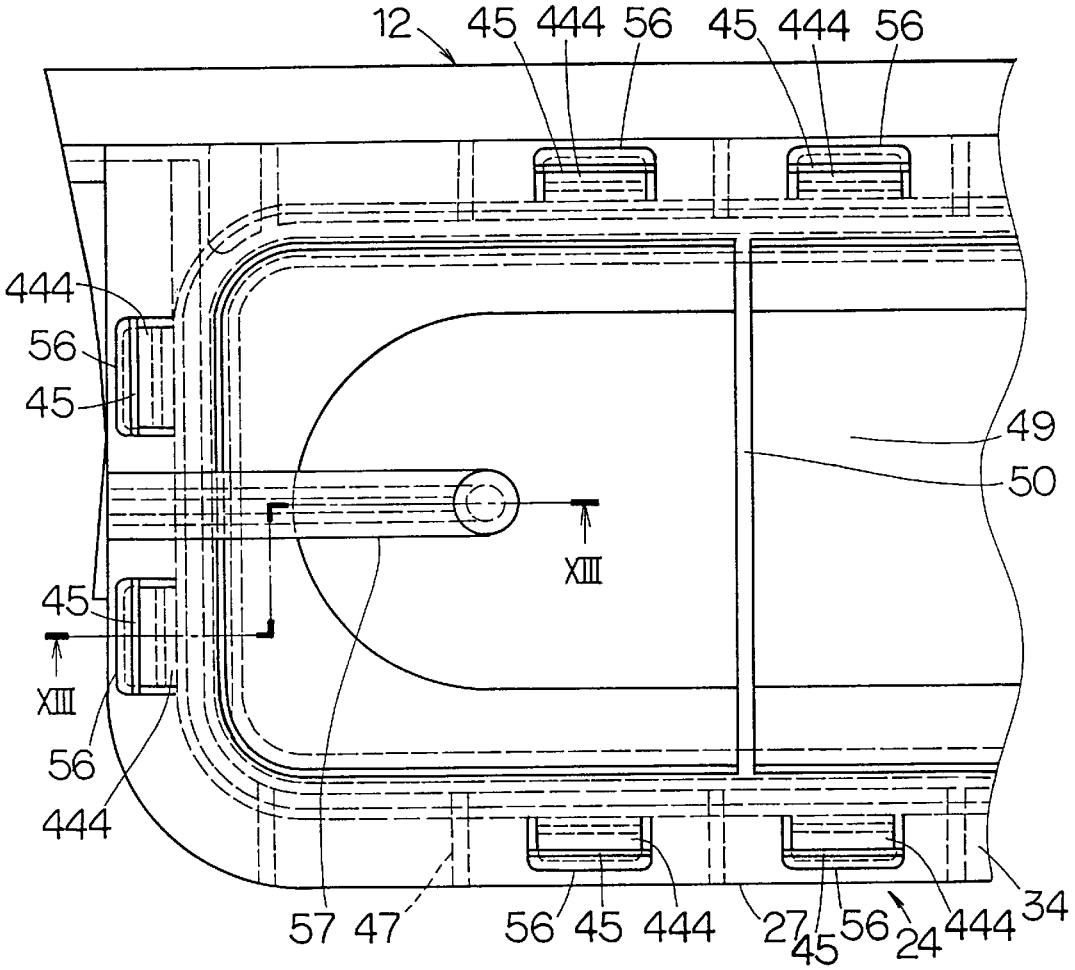
FIG. 12 is a plan view of an anchoring structure of a cover member and a tank body in a third preferred embodiment.
Figure 13:
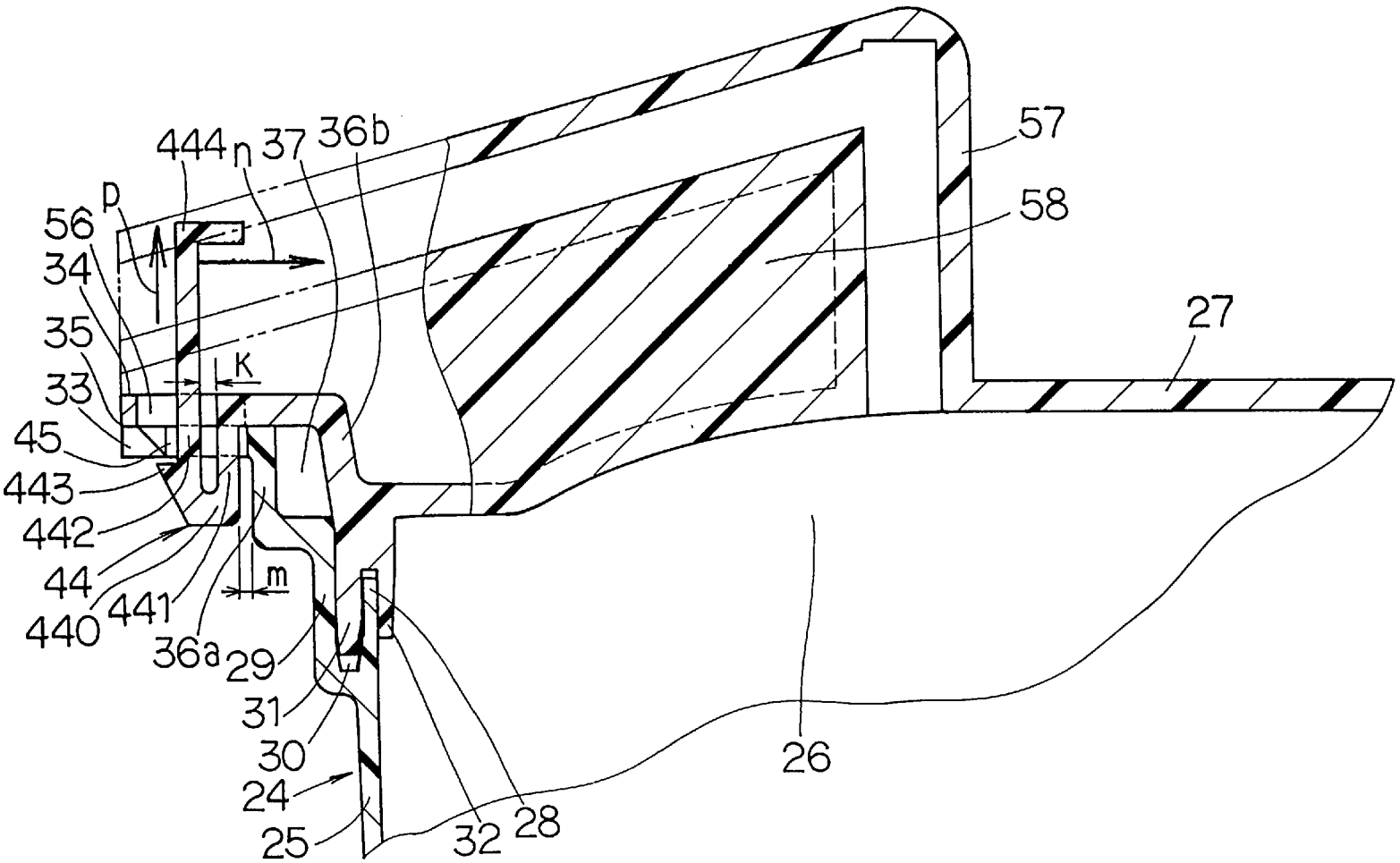
FIG. 13 is a sectional view of partially the anchoring structure, taken along XIII—XIII line of FIG. 12.

FIGS. 12, 13 show a third preferred embodiment of the present invention. In the first and second embodiments the filling pipe 39 is formed on the cover member 27 and the filling cap 40 is removably fitted to the filling pipe 39, and by removing the filling cap 40 coolant could be poured through the filling pipe 39 into the reserve tank 24 (the tank body 25). As opposed to this, in the third embodiment by making the cover member 27 itself perform the role of a filling cap 40 it is made possible for the filling pipe 39 and the filling cap 40 and so on to be dispensed with.

To this end, in the third embodiment the cover member 27 is designed so as to be easily attached to and removed from the opening part 26 of the tank body 25 compared to the first and second embodiments. Specifically, as shown in FIGS. 12, 13, a plurality of engaging projections 44 are integrally formed along the outer periphery on the lower face of the flange-like part 34 of the cover member 27 in the same way as in the first and second embodiments. The engaging projections 44 are pushed from above into the anchoring holes 45 opened in the flange-like part 33 of the tank body 25 to anchor-engage with the anchoring holes 45.

Here, the anchoring holes 45 are of a simple rectangular shape, but the engaging projections 44 are made a shape having a U-shape part 440 projecting downward in a sectional U-shape from the lower face of the flange-like part 34. The U-shape part 440 is made up of an inner side wall part 441 extending vertically downward integrally from the flange-like part 34 and an outer side wall part 442 positioned on the outer side of this inner side wall part 441 with a predetermined gap k opened therebetween. On the other hand, a rectangular through hole 56 is opened in the flange-like part 34 in a positional relationship such that it overlaps with the anchoring hole 45.

A predetermined gap m is set between the inner side wall part 441 of the U-shape part 440 and the step part 36*a* of the upwardly rising part of the outer side wall part 29 of the tank body 25. On the other hand, in a part-way of the outer side wall part 442 of the U-shape part 440, a claw part 443 projecting to the outer side is formed. The projecting height of the claw part 443 is set as follows. That is, the projecting height of the claw part 443 is set so that, in a free state wherein no outside force is acting on the engaging projection 44, the claw part 443 is engaged by a predetermined dimension with the outer side periphery of the anchoring hole 45 of the flange-like part 33 of the tank body 25.

The outer side wall part 442 of the U-shape part 440 of the engaging projection 44 is made a shape such that it rises upward through the through hole 56 of the flange-like part 34 and constitutes a grip part 444 of a shape bent in an L-shape above the flange-like part 34. The bend direction of the grip part 444 in FIG. 12 is the inner side direction, but reversely the bend direction may be made the outer side direction of FIG. 12.

Removal and replacement of the cover member 27 are carried out using elastic deformation of the engaging projections 44. Therefore, a resin material having a certain amount of elasticity, and, in the fitted state of the cover member 27 to surely maintain the state of engagement between the claw parts 443 of the engaging projections 44 and the outer side peripheries of the anchoring holes 45, having little deformation with time is preferable as the material of the cover member 27. As a resin material having this kind of property for example polypropylene containing glass fibers, and polypropylene containing talc and the like are desirable.

Further, a drain pipe 57 corresponding to the drain pipe 41 of the filling cap 40 in the first and second embodiments is integrally formed on the top face of the cover member 27. The drain pipe 57 is of a shape bending in an L-shape slightly downward from the horizontal direction after rising vertically upward. Here, the tip end part of the drain pipe 57 may be open directly to the atmosphere, but alternatively a drain hose 42 (see FIGS. 1, 6, 10, 11) may be connected to the tip end part of the drain pipe 57. Between the part of the drain pipe 57 extending in the horizontal direction and the top face of the cover member 27, a connecting wall part 58 connecting these is integrally formed.

Next, the operations of removing and refitting the cover member 27 of the third embodiment will be explained. On fitting of the cover member 27, the plurality of engaging projections 44 projecting to the lower face side of the flange-like part 34 of the cover member 27 are pushed from above into the anchoring holes 45 opened in the flange-like part 33 of the tank body 25 and made to anchor/engage with the anchoring holes 45.

Here, because the engaging projections 44 have the predetermined gap k set between the inner side wall part 441 and the outer side wall part 442 and the predetermined gap m set between the inner side wall part 441 and the step part 36*a* of the outer side wall part 29 of the tank body 25, the engaging projections 44 elastically deforms easily. As a result, when the engaging projections 44 are pushed from above into the anchoring holes 45, the claw part 443 of the outer side wall part 442 presses against the inner wall faces of the anchoring hole 45 and a force in the inner side direction acts on the engaging projection 44. Accordingly, the whole of the U-shape part 440 of the engaging projection 44 elastically deforms in the inner side direction with the root part of the inner side wall part 441 as a support point. As a result of this elastic deformation of the whole of the U-shape part 440, the claw part 443 passes through the anchoring hole 45 and is anchor/engaged with the outer side periphery of the anchoring hole 45. Thus, the fitting of the cover member 27 to the tank body 25 can be finished.

With respect to this, on removal of the cover member 27 from the tank body 25, a force in the inner side direction shown with arrow n is applied to the grip part 444 of each of the engaging projections 44. Because consequently the whole of the U-shape part 440 of the engaging projection 44 elastically deforms in the inner side direction with the root part of the inner side wall part 441 as a support point, the claw part 443 also displaces in the inner side direction and the claw part 443 is disengaged from the outer side periphery of the anchoring hole 45.

Because the engaging projections 44 are provided in a plurality, for example 12, in the periphery direction of the flange-like part 34 of the cover member 27, the release of the engaged state of the claw parts 443 of the engaging projections 44 is in practice carried out several at a time.

After the claw part 443 is released from the anchoring hole 45, by the grip part 444 being lifted by a small amount in the upper side direction shown with arrow p, the claw part 443 is made to abut with the inner wall face of the anchoring hole 45 and the engagement-released state of the claw part 443 is thus temporarily held. Then, after all of the engaging projections 44 are brought to the claw part 443 engagement-released state, by lifting the whole of the cover member 27 in the upper side direction shown with arrow p with the grip parts 444 being held, the cover member 27 can be removed from the tank body 25.

In the third embodiment, as understood from FIG. 12, because a plurality of the engaging projections 44 are provided on each of the four sides of the flange-like part 34 of the cover member 27, on each of the four sides of the flange-like part 34 the plurality of grip parts 444 may be integrally connected so that the plurality of grip parts 444 can be manipulated at once.

(Other Embodiments)

In the first through third embodiments described above, in the press-fitting part constituting the seal mechanism of the cover member 27 to the tank body 25, the projection 31 is formed on the cover member 27 side and the concave part 30 into which the projection 31 fits is formed on the tank body 25 side. However, reversely to this, the projection 31 may be formed on the tank body 25 and the concave part 30 into which the projection 31 fits may be formed on the cover member 27.

In the first through third embodiments described above, as the anchoring structure of the cover member 27, the engaging projections 44 are formed on the cover member 27 and the anchoring holes 45 into which the engaging projections 44 fit/engage are formed on the tank body 25. However, reversely to this, the engaging projections 44 may be formed on the tank body 25 and the anchoring holes 45 into which the engaging projections 44 fit/engage may be formed on the cover member 27.

In the first through third embodiments, a case was described wherein the two cylindrical air guide parts 13, 14 are opened in a line in the left-right direction of the fan shroud 12 of a laterally long shape and the cooling fans 15, 16 are disposed respectively inside the cylindrical air guide parts 13, 14, and the reserve tank 24 is disposed in the upper side of the left-right direction central part of the fan shroud 12. However the invention can also be applied to a fan shroud holding only one cooling fan. In this case, the reserve tank 24 can be disposed in either of the left and right upper side portions of the resin fan shroud. In the first through third embodiments, the present invention is applied to an engine cooling apparatus for a vehicle, but the invention can also be applied to an engine cooling apparatus other than for a vehicle.

While the present invention has been shown and described with reference the foregoing preferred embodiments, it will be apparent to those skilled in the art that changes in form and detail may be made therein without departing from the scope of the invention as defined in the appended claim.

What is claimed is:

1. A fan shroud for an engine cooling apparatus including a radiator for cooling coolant of an engine and a cooling fan for blowing cooling air to the radiator, the fan shroud comprising:

a resin fan shroud member for covering the cooling fan to guide the cooling air to the radiator; and a reserve tank integrated with the fan shroud member for storing coolant therein, the reserve tank having a tank body defining a tank space therein with an opening portion and a tank cover member for covering the opening portion, the tank cover member being detachably attached to the tank body via an anchoring structure the tank space shaped such that a molding die for forming the tank space is removed through the opening portion when the tank body is formed integrally with the fan shroud member by an injection molding method.

2. The fan shroud of claim 1, wherein the tank cover member has a filling port for pouring coolant into the tank body and a filling cap for detachably covering the filling port.

3. The fan shroud of claim 1, wherein:

the tank body has a tank body flange-like part provided on a periphery of the opening portion;

the tank cover member has a tank cover flange-like part provided on a periphery thereof for abutting the tank body flange-like part; and the tank body flange-like part and the tank cover member have the anchoring structure for preventing detachment of the tank cover member from the tank body.

4. The fan shroud of claim 3, wherein:

the tank body flange-like part has an anchoring hole; and the tank cover flange-like part has an engaging projection and a tank cover hole both provided at a position facing the anchoring hole, the engaging projection having a U-shape part for being inserted into the anchoring hole, the U-shape part having a first wall integrally connected with the tank cover flange-like part and a second wall extending parallel to the first wall and protruding through the tank cover hole on an opposite side of the tank body flange-like part with respect to the tank cover flange-like part.

5. The fan shroud of claim 4, wherein the engaging projection has e claw part on one of the first and second walls of the U-shape part, for being hooked on a surface of the tank body flange-like part on an opposite side of the tank cover flange-like part.

6. The fan shroud of claim 4, wherein the U-shape part of the engaging projection is elastically deformed when the tank cover member is attached to and detached from the tank body.

7. A fan shroud for an engine cooling apparatus including a radiator for cooling coolant of an engine and a cooling fan for blowing cooling air to the radiator, the fan shroud comprising;

a resin fan shroud member for covering the cooling fan to guide cooling air to the radiator;

a reserve tank integrated with the fan shroud member for storing coolant, the reserve tank having a tank body having an opening portion and a tank cover member for liquid-tightly sealing the opening portion, an inside of the tank body shaped such that a molding die for forming the inside of the tank body is removed through the opening portion when the tank body is integrally formed with the fan shroud by an injection molding method, wherein one of the tank body and the tank cover member around the opening portion has a concave part; and wherein the other of the tank body and the tank cover member around the opening portion has a projection for fitting into the concave part to provide a fluid-tight sealing portion in cooperation with the concave part.

8. The fan shroud of claim 7, wherein the tank cover member and the tank body define a space for collecting coolant leaked from the tank body through the sealing portion.

9. The fan shroud of claim 8, wherein the space is formed around the entire circumference of the opening portion of the tank body.

10. The fan shroud of claim 8, wherein the space communicates with an outside of the tank body through a discharge hole for discharging coolant from the space to the outside.

11. The fan shroud of claim 10, wherein:

the tank cover member and the tank body have flange-like parts extending outwardly from the sealing portion and contacting each other; and the space for collecting coolant is provided between the flange-like portions and the sealing portion.

12. The fan shroud of claim 8, wherein the tank cover member has a dischage hole communicating with the space for dischaging coolant from on the cover member to the space.

13. The fan shroud of claim 7, wherein one of the tank body and the tank cover member has a step portion for forming the space with the other of the tank body and the tank cover member, the step portion elongating from the sealing portion and bent outwardly.

14. The fan shroud of claim 7, wherein the tank body and the tank cover member has an anchoring structure for preventing detachment of the tank cover member from the tank body, the anchoring structure comprising an engaging projection of one of the tank cover member and the tank body and an anchoring hole of the other of the tank cover member and the tank body for receiving the engaging projection.

15. The fan shroud of claim 14, wherein the engaging projection has a pillar part and a claw part provided on a top of the pillar part, the claw part projecting outwardly in a radial direction of the pillar part.

16. The fan shroud of claim 15, wherein:

the anchoring structure is disposed on a periphery of the opening portion of the tank body; and the claw part of the engaging projection is provided only on an outer side of the opening portion with respect to an edge line of the opening portion.

17. The fan shroud of claim 7, wherein the tank body and the tank cover member have a plurality of ribs for increasing rigidity of the tank body and the tank cover member.

18. The fan shroud of claim 7, wherein the fan shroud member and the tank body are integrally formed from resin containing carbon with an amount smaller than 0.003 wt %.

19. The fan shroud of claim 7, wherein the fan shroud member and the tank body are made gray to exhibit a level of coolant inside the tank body therethrough.

20. The fan shroud of claim 7, wherein the tank body has a thinner wall part than the other part of the tank body for checking a level of coolant inside the tank body.

21. The fan shroud of claim 7, further comprising a connecting pipe connecting a bottom portion of the tank body and the radiator for supplying coolant from the tank body to the radiator, wherein the tank body has a partition plate protruding from the bottom portion within the tank body to divide the bottom portion into a part directly communicating with the connecting pipe and the other part for holding a small amount of coolant.

22. A fan shroud for an engine cooling apparatus including a radiator for cooling coolant of an engine and a cooling fan for blowing cooling air to the radiator, the fan shroud comprising;

a resin fan shroud member for covering the cooling fan to guide the cooling air to the radiator; and a reserve tank integrated with the fan shroud member for storing coolant therein, the reserve tank having a tank body defining a tank space therein with a bottom portion and an opening portion, and a tank cover member for covering the opening portion, the tank space having a sectional area parallel to the opening portion, the sectional area increasing or being constant with progress from a bottom portion side to an opening portion side, wherein one of the tank body and the tank cover member has an anchoring hole; and wherein the other of the tank body and the tank cover member has an engaging projection for fitting into the anchoring hole, the engaging projection having a pillar part elongating approximately in parallel with the anchoring hole, and a claw part extending from the pillar part approximately perpendicularly to the pillar part only on a side opposite to the opening portion.

23. The fan shroud of claim 22, wherein:

the tank body and the tank cover member have flange-like parts abutting one another; and the anchoring hole and the engaging projection is formed in and on the flange-like parts.

24. A fan shroud for an engine cooling apparatus including a radiator for cooling coolant of an engine and a cooling fan for blowing cooling air to the radiator, the fan shroud comprising:

a resin fan shroud member for covering the cooling fan to guide the cooling air to the radiator; and a reserve tank integrated with the fan shroud member for storing coolant therein, the reserve tank having a tank body defining a tank space therein with an opening portion and a tank cover member for covering the opening portion, the tank space shaped such that a molding die for forming the tank space is removed through the opening portion when the tank body is formed integrally with the fan shroud member by an injection molding method; wherein the tank body has a tank body flange-like part provided on a periphery of the opening portion;

the tank cover member has a tank cover flange-like part provided on a periphery thereof for abutting the tank body flange-like part; and the tank body flange-like part and the tank cover member have an anchoring structure for preventing detachment of the tank cover member from the tank body.

* * * * *